United States Patent [19]

McMullan

[11] 4,352,976

[45] Oct. 5, 1982

[54] TEMPERATURE CONTROLLED HEATER

[76] Inventor: James P. McMullan, 12300 Monarch St., Garden Grove, Calif. 92641

[21] Appl. No.: 186,975

[22] Filed: Sep. 15, 1980

[51] Int. Cl.[3] ..... H05B 3/00

[52] U.S. Cl. ..... 219/217; 5/422; 219/328; 219/527

[58] Field of Search ..... 219/211, 212, 217, 313, 219/328, 527, 523, 528; 5/370, 421, 422; 126/372; 128/376, 33, 399, 400

[56] References Cited

U.S. PATENT DOCUMENTS

| | | | |
|---|---|---|---|
| 3,746,835 | 7/1973 | Yu et al. | 219/217 |
| 3,760,147 | 9/1973 | Tyrey | 219/217 |
| 3,790,753 | 2/1974 | Miller | 219/528 |
| 4,097,717 | 6/1978 | Phillips | 219/217 |
| 4,114,215 | 9/1978 | Santo | 5/370 |
| 4,222,848 | 9/1980 | McMullan et al. | 219/528 |
| 4,233,492 | 11/1980 | McMullan et al. | 219/217 |
| 4,270,040 | 5/1981 | McMullan et al. | 219/528 |
| 4,278,869 | 7/1981 | McMullan | 219/527 |

*Primary Examiner*—Volodymyr Y. Mayewsky

[57] ABSTRACT

The combination of a water bed structure comprising a horizontal platform, a water-filled flotation mattress with a bottom wall atop the platform and a retainer projecting upwardly from the platform and supporting the perimeter of the mattress, and a heater system maintaining the mattress at a set operating temperature including a resistance heater between the platform and said bottom wall and spaced inward from the retainer; temperature control means for the heater including a control unit at the exterior of the bed structure, a service cord between the unit and a power source, an elongate flexible electrical loom having inner and outer end portions and including an outer jacket, a pair of power lines coextensive therewith and a pair of current conductors coextensive with the inner portion thereof, a temperature sensing device within the central portion of the loom and connected between the conductors, the inner ends of the lines connect with the heater, the outer ends of the lines and conductors are connected with a switching circuit in the unit, the loom extends from the unit to the heater between the platform and mattress whereby said device is positioned in thermal responsive relationship with the matttress and is thermally isolated from the heater.

8 Claims, 22 Drawing Figures

U
22
12
12'
11
21
H
S
L
V

6
L
16
14
13

6
T
15
15

L
16
14
13
13

12
14
12'
11

16
14''
14''
14
13

T
14''
V
L
14
13

T
V
L
14
13

M
L
T
V
H

Fig. 13.
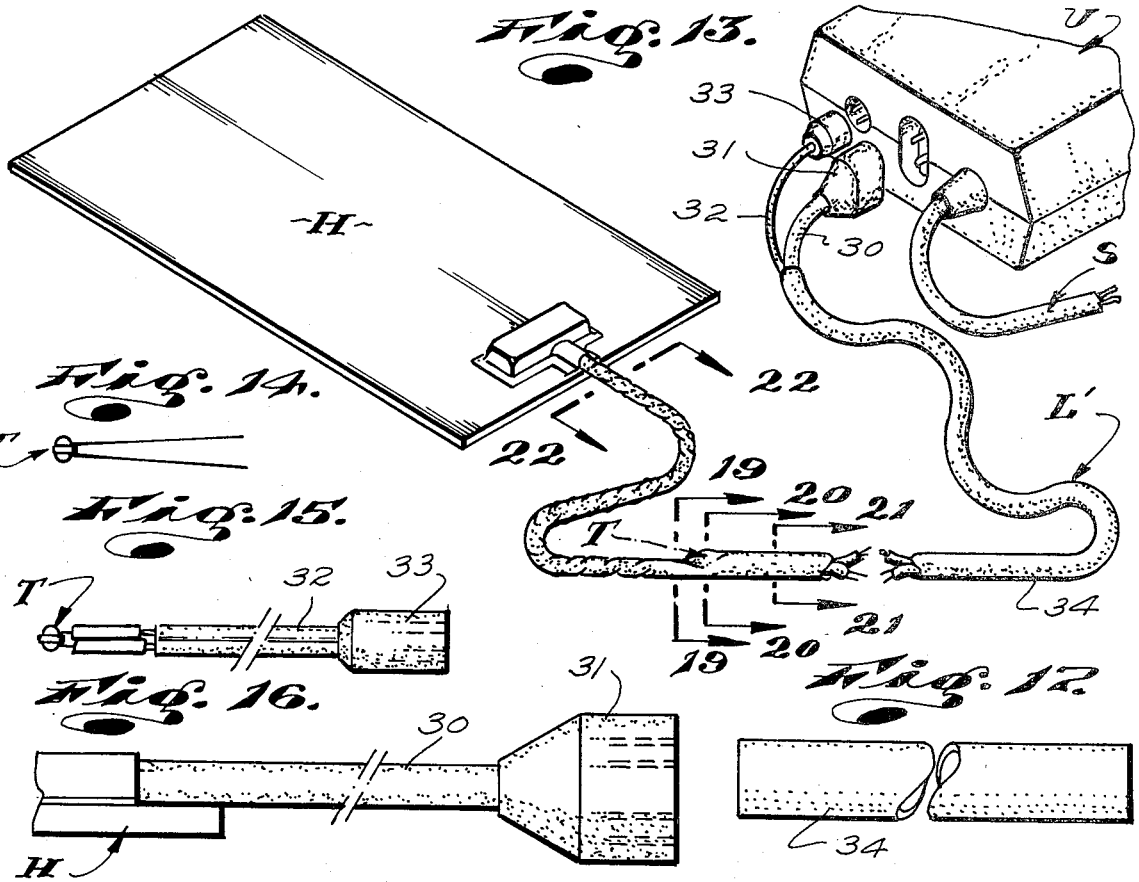
Fig. 14.
Fig. 15.
Fig. 16.
Fig. 17.
Fig. 19. Fig. 20. Fig. 21. Fig. 18.
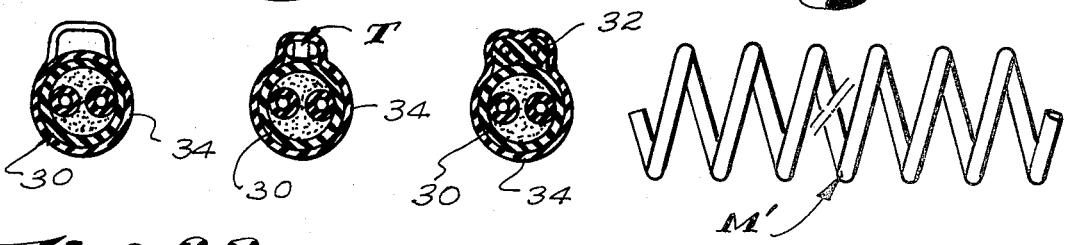
Fig. 22.
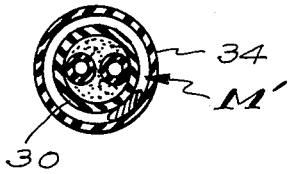

TEMPERATURE CONTROLLED HEATER

BACKGROUND OF THE INVENTION

In the art of water beds, blanket-type electric resistance heaters are provided to heat and maintain the water in flotation mattresses at desired and comfortable temperature. The heaters are arranged in flat engagement between the flat mattress supporting platforms of the water bed frames and the bottom walls of the water filled, bladder-like flotation mattresses. Control means are provided to adjust and set the temperature to be maintained in the mattresses. The control means include box-like control units with manually operable temperature adjusting knobs arranged at the exterior of the beds and connected with the heaters by elongate flexible power cords and with power service outlets, remote from the beds, by elongate flexible service cords. In addition to the above, the control units are provided with small temperature sensing devices, such as thermocouples or thermosters at the free ends of thin, elongate, flexible conductors. The conductors extend from the control units between their related bed platforms and mattresses to arrange the temperature sensing devices at their ends in heat conducting contact with the mattresses, in effective operating spaced relationship from the heaters and the sides of the bed structures.

The above noted control units include suitable switching circuits which operate to turn the flow of current through the heaters on and off in response to the temperature sensed by the temperature sensing devices, whereby the heaters operate continuously until the temperature of their related mattresses reach set temperatures and are thereafter turned on and off to maintain the temperature of the mattresses at said set temperature.

While the above type of water bed heaters and control means therefore have proven to be reasonably satisfactory, a notable and serious problem which is often encountered is the misplacement and/or displacement of the temperature sensing devices which result in the failure and/or inability of the control means to operate as intended.

For example, it is not infrequent that the temperature sensing devices occur adjacent to or in excessively close proximity to the heaters with the result that the devices operate in response to the temperature of the heaters, rather than to the temperature of the mattresses. When this occurs, the heaters are turned off before the mattresses can be brought up to set temperature.

In other instances, the sensing devices occur in air pockets defined by and between the mattresses and their related platforms. As a result, desired heat conducting contact between the devices and the mattresses is not established and the heaters are turned on and caused to operate for excessive periods of time. This results in overheating the mattresses and/or cause other serious and irreparable damage.

In both of the examples given above, the sensing devices are either misplaced during assembly of the beds and installation of the heaters and sensing devices or the devices are pulled or otherwise caused to move out of proper set position by normal working of the beds, over protracted periods of time. More often than not, improper installation is a cause.

Improper installation of the heaters and of the temperature sensing devices in water bed structures is generally the result of the inability of the purchasers and "do it yourself" installers of the heaters and their control means to understand and/or follow the simplest of printed installation instructions which are commonly provided with water beds and water bed heating means.

Adding to the above is the fact that the separate elongate flexible power cords extending from the heaters to the control units and the elongate flexible conductors extending from the temperature sensing devices to the control units are oftentimes difficult to manipulate and frequently become adversely twisted and tangled during and before installation can be completed, with the result that relative placement of the heaters and sensing devices is not readily determinable.

It should be noted that very few people understand and appreciate the reasons for and the importance of properly installing the heat sensing devices of water bed heater control means and that the overwhelming majority of persons who buy and install water bed heating means are without that special knowledge and background which would enable them to understand the best of installation instructions with sufficient certainty to knowingly effect proper assembly and/or installation of the equipment involved.

In addition to the above, and possibly a more serious problem found to exist in the common installation of water bed heaters and control means therefore resides in the fact that during normal use and working of the beds, the heaters and temperature sensing devices tend to move or migrate between the bed platforms and mattresses and are subject to being adversely displaced. Such movement and/or displacement of parts can result from intermittent, inadvertent, tugging or pulling of portions of the power cords and conductors occurring at the exterior of the beds and/or can be caused by those wave or surge generated forces which are transmitted through and between the mattresses and the platforms, and thus onto and through the portions of the cores and conductors extending between the mattresses and platforms. While the flat blanket-type heaters (having great surface areas) are not frequently caused to move and become displaced in the manner set forth above, the small temperature sensing devices and their related flexible conductors are highly susceptible to being moved and displaced under the above noted conditions and/or circumstances.

In addition to the foregoing, the fact that the power cords for the heaters and the conductors for the temperature sensing devices are separate or independent from each other compounds the likelihood that a cord or conductor will be inadvertently engaged, at the exterior of the bed structure, and subjected to forces which are likely to displace structure, as noted in the preceding or cause other adverse effects.

OBJECTS AND FEATURES OF THE INVENTION

It is an object of my invention to provide an improved water bed heater system or means of the character referred to above which is such that the above noted shortcomings and/or disadvantages found in such systems or means provided by the prior art are effectively eliminated.

Another object of the invention is to provide an improved water bed heater system of the character referred to which is such that placement of the temperature sensing device in effective operating relationship with a related mattress and heater is substantially assured when installation is effected without the exercise of special knowledge and/or skill.

Yet another object and feature of the invention is to provide a water bed heater system or means of the character referred to above wherein the small temperature sensing device and its related elongate flexible conductor are related to and carried by or integrated with the elongate flexible power cord for the heater whereby a single cable or loom containing the heater power cord, sensing device and the conductor therefor extends from the heater, between the bed platform and mattress, to the control unit at the exterior of the bed structure, whereby the sensing device occurs between the platform and the mattress in substantial predetermined spaced relationship from the heater.

Still another object and feature of the invention is to provide a portion of the cable or loom occurring between the heater and the temperature sensing device with means to normally yieldingly urge and maintain that portion of the cable or loom straight, whereby the cable or loom will not readily move to and establish positions where the temperature sensing device is excessively close to the heater.

It is an object and feature of this invention to provide a cable or loom of the character referred to which includes an elongate flexible tubular sheath of electric insulating material through which wire of the power cord and conductor extend and which holds the temperature sensing device at one end of the conductor in secure relationship with a side of the sheath and in predetermined spaced relationship from the heater at one end of the cable or loom.

An object and feature of the invention is to provide a cable or loom of the character referred to above wherein the means to normally yieldingly urge and maintain that portion of the loom between the heater and the temperature sensing device straight is an elongate, normally straight helically formed spring suitably embodied with the cable or loom.

Still another object and feature of this invention is to provide a cable or loom of the character referred to above which engages a related mattress and functions to conduct heat from the mattress to the temperature sensing device within it in the event heat from the mattress is not conducted substantially directly to it through the sheath.

It is an object and feature of this invention to provide a cable or loom structure of the character referred to above which functions as a heat pipe to conduct heat from a mattress which it engages to the heat sensing device within it whereby subjecting the temperature sensing device to the temperature of the mattress is assured.

The foregoing and other objects and features of my invention will be apparent and will be fully understood from the following detailed description of the invention, throughout which description reference is made to the accompanying drawings.

DESCRIPTION OF THE DRAWINGS p FIG. 1 is an isometric view of a water bed structure with a heater system embodying my invention related to it;

FIG. 13 is an isometric view of another embodiment of my invention;

FIG. 14 is a view of a temperature sensing device;

FIG. 15 is a view of the temperature sensing device with a conductor cord related to it;

FIG. 16 is a view of a portion of the heater and portions of its power cord;

FIG. 17 is a view of portions of a jacket structure;

FIG. 18 is a view of a spring;

FIG. 19 is a view taken as indicated by line 19—19 on FIG. 13;

FIG. 20 is a view taken as indicated by line 20—20 on FIG. 13;

FIG. 21 is a view taken as indicated by line 21—21 on FIG. 13; and

FIG. 22 is a view taken as indicated by line 22—22 on FIG. 13.

DETAILED DESCRIPTION OF THE INVENTION

Figure 1:
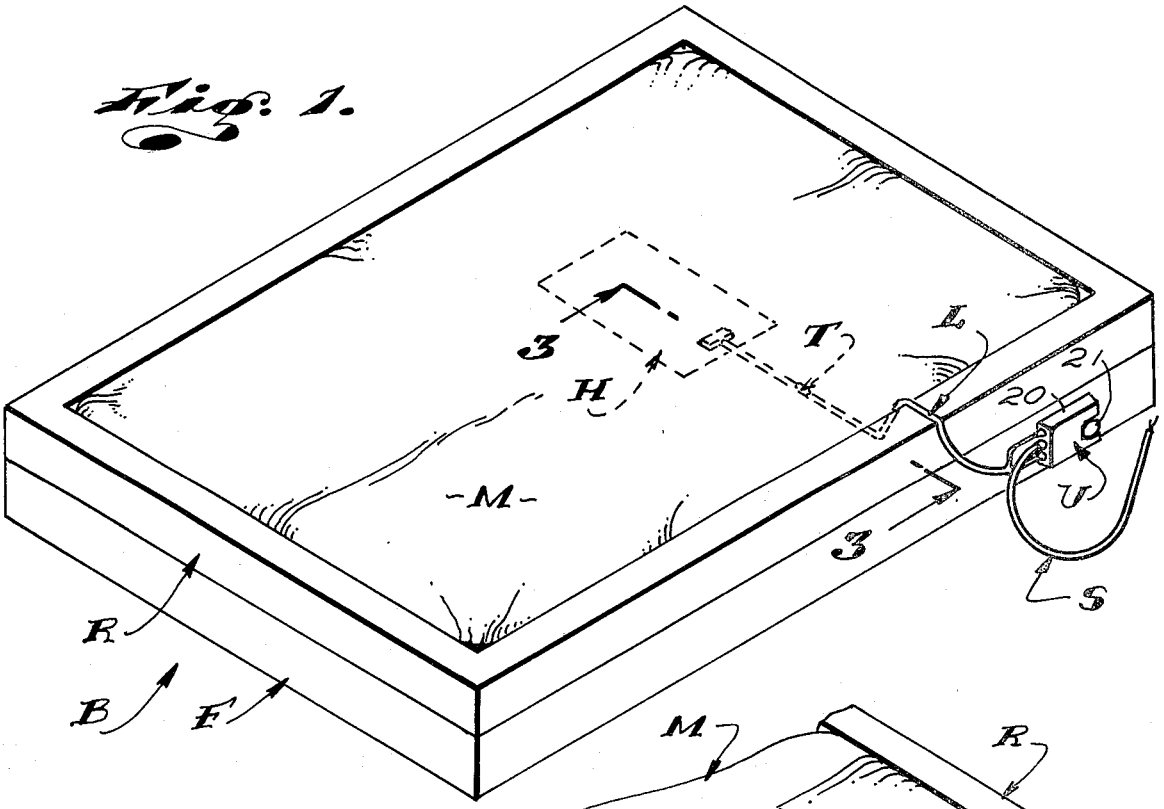
Figure 2:
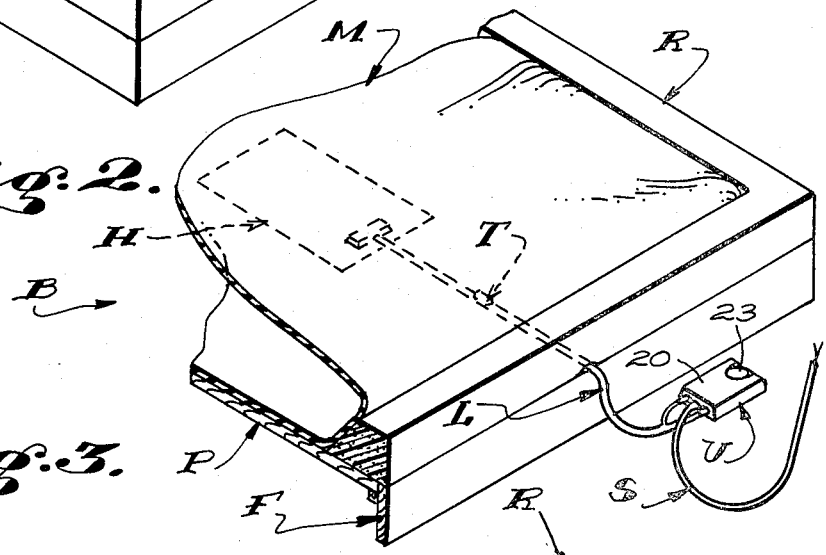
FIG. 2 is an isometric view of a portion of the structure shown in FIG. 1 with parts arranged in a different manner.
Figure 3:
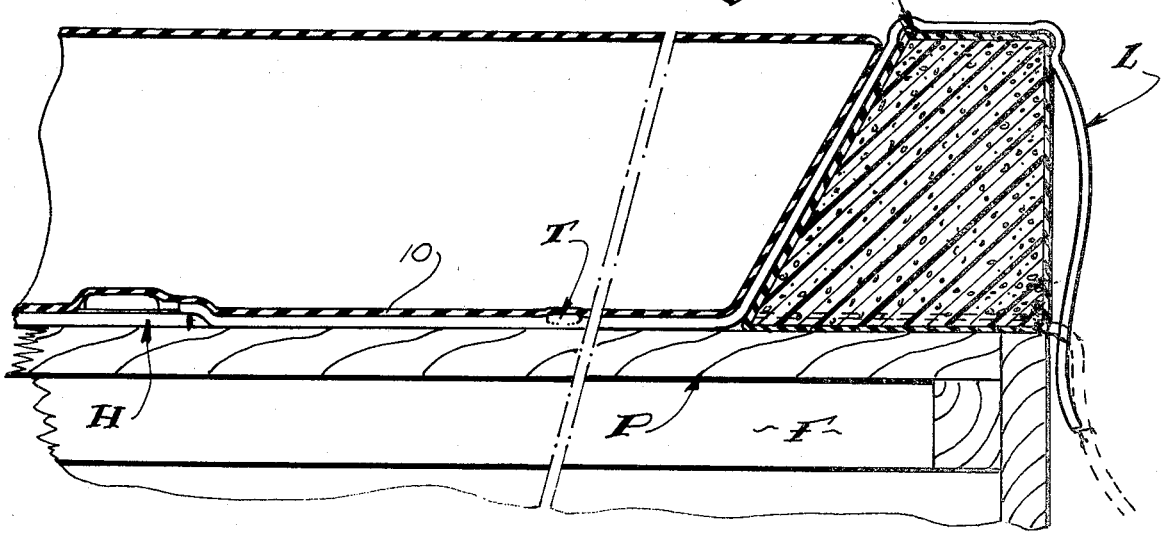
FIG. 3 is an enlarged sectional view taken as indicated by line 3—3 on FIG. 1.

In FIGS. 1 through 3 of the drawings, I have shown my new heater system A related to one typical water bed structure B. The bed structure B includes a lower frame F defining a flat horizontal, upwardly disposed mattress supporting platform P and a retainer R about and projecting upwardly from the perimeter of the platform P. The retainer R can be an integral part of the frame F or can, as shown, be a separate part arranged above and supported by the frame F.

The bed structure B next includes a flexible, bladder-like, water-filled flotation mattress M. The mattress M is arranged atop and is supported by the platform P and is held or retained about its perimeter against outward displacement by the retainer R.

The heater system A for the bed B includes a flat, horizontal blanket-type electric resistance heater H with an elongate flexible, jacketed power cable or loom L fixedly secured and extending outwardly from it to connect with a heater control unit U. The loom L has two pairs of elongate flexible, jacketed electric current lines or conductors extending longitudinally through it. The heater control unit U has or is connected with an elongate flexible service cord which extends from the unit U to a suitable electric power source, such as a conventional domestic power service outlet (not shown) with which it is releasably coupled.

The system A further includes a temperature sensing device T. In the preferred carrying out of my invention, the device T is arranged within the cable or loom L which extends from the heater H and connects with the unit U. The device T can be in the form of a thermocouple, thermoster or other suitable thermally responsive electric device which is effective to cause a related switching circuit to open and close in response to changes in temperature of or "sensed by" the device.

The heater H is a flat, horizontal blanket type electric resistance heater such as is produced by Western Control Equipment Co., of Garden Grove, California, and sold under the tradename "Ultratherm". The heater H is arranged in flat bearing and heat-conducting contact with and between the platform P and a bottom wall 10 of the mattress M, which opposes and is supported by the platform P.

In accordance with good practices, the heater H is spaced a substantial distance inward from the outer sides or perimeter of the mattress where most effective and efficient transfer of heat, between the heater and the mattress, is assured.

The power cable or loom L, the inner or one end of which is fixedly connected with the heater H, extends outward from the heater, between the platform and the mattress and thence upward and outward between and from the mattress and the inner perimeter of the retainer R, as clearly shown in FIGS. 1 and 3 of the drawings. Alternatively, the loom L can extend below the retainer R and thence outwardly from between the retainer and the platform P, as shown in FIG. 2 of the drawings and as indicated in dotted lines in FIG. 3 of the drawings.

The other or outer free end of the loom L is provided with a primary plug 11 of a releasable plug and socket type electric power coupling and a secondary current plug 12 of a releasable plug and socket electric power coupling and a secondary current plug 12 of a releasable plug and socket electric power coupling. The power plug 11 is connected with the outer ends of a pair of power conducting lines 13 within and coextensive with the loom L. The inner ends of the lines 13 connect with the resistance element (not shown) of the heater H. The current plug 12 is connected with the outer free ends of a pair of current conducting lines or conductors 14 of and extending through the loom L.

The primary or power plug 12 can, as shown, be a typical molded plug structure formed at and integrally joined with its related end of the loom L.

The secondary or conductor plug 12 is related to the outer free ends of suitable extensions 14' of the conductors 14 which extensions are shown projecting outwardly from one side of the primary power plug 11.

The plug 12 is preferably a typical molded plug structure having an elongate flexible jacket 12' extending from it and extending about the extensions 14'. The end of the jacket 12' remote from the plug 12 is integrally joined with the plug 11, as clearly shown in FIGS. 4 and 11 of the drawings.

It is believed to be abundantly clear that the particular form of plugs, and their relationship with each other and with the loom L and its several conductors, is only typical of one of several distinct conductor and plug structures and assemblies that might be advantageously employed in carrying out my invention.

Figures 4, 5, 6, 7, 8, 9, 10, 11, 12:
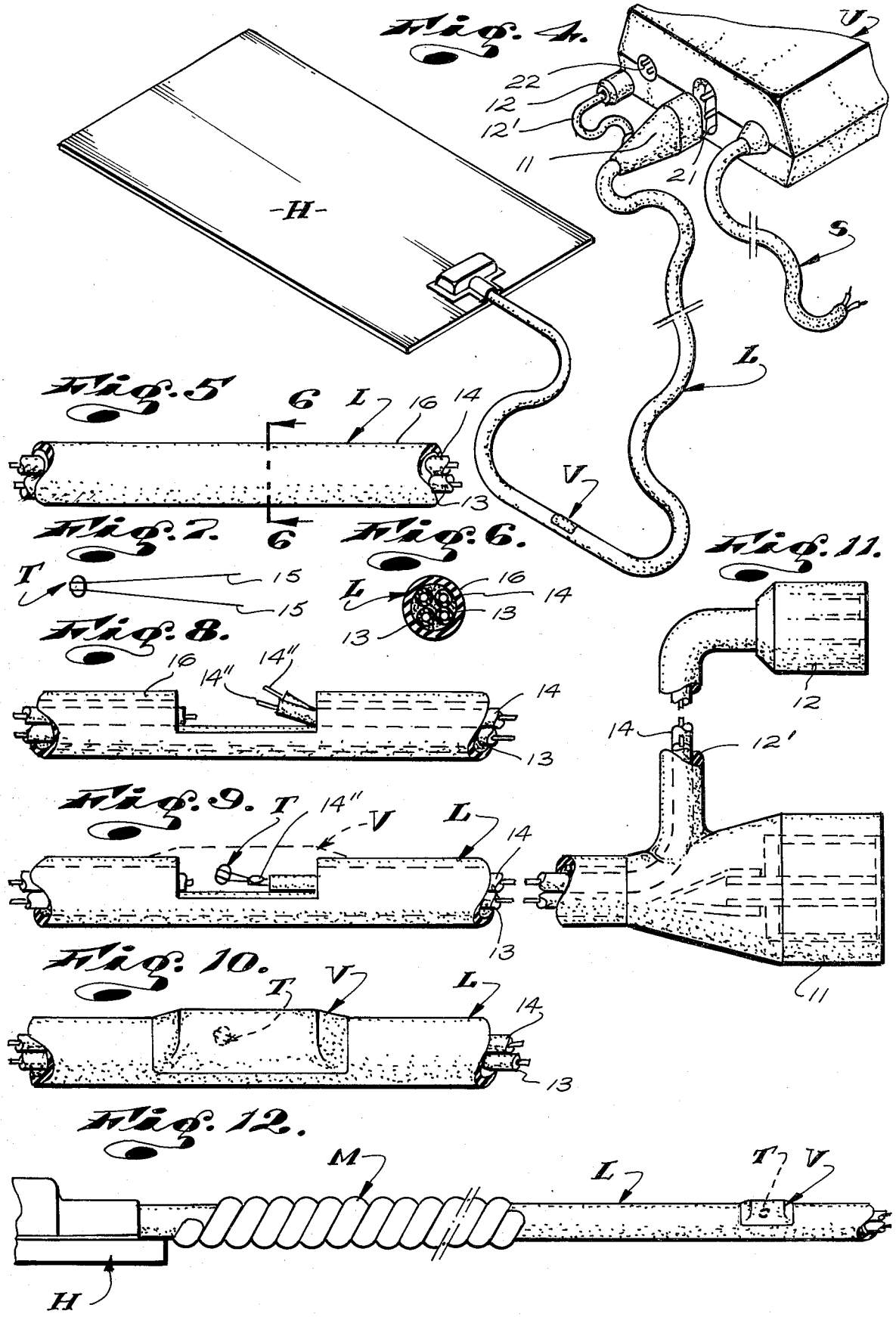
FIG. 4 is an isometric view showing the heater system separate from the bed structure.
FIG. 5 is a view of a portion of an electric cable.
FIG. 6 is a sectional view of the cable taken as indicated by line 6—6 on FIG. 5.
FIG. 7 is a view of a temperature sensing device separate from related structure.
FIG. 8 is a view of the cable prepared to receive the temperature sensing device.
FIG. 9 is a view similar to FIG. 8 showing the device related to the cable.
FIG. 10 is a view showing the device embodied in a deposit of material carried by the cable.
FIG. 11 is a view showing another portion of the cable with electric coupling plugs related to it.
FIG. 12 is a view of another portion of the cable and of structure related to it.

The temperature sensing device T, shown separate in FIG. 7 of the drawings, is arranged within the loom L to occur in predetermined spaced relationship, longitudinally outward from the heater H. More particularly, the device T is arranged in the loom M at a location longitudinally thereof, which is spaced a sufficient distance from the heater H so that the device T and the portion of the loom immediately adjacent to it are not directly affected or influenced by heat generated by the heater H.

Further, the device T is located in the loom L at a position spaced from, but sufficiently close to, the heater H so that when the heater H is arranged beneath the central portion of the mattress M and the loom L is extended outwardly therefrom to one side of the bed structure, as shown in the drawings, the device T is in a portion of the loom L which extends between and is in direct heat conducting contact with the bottom wall 10 of the mattress M.

As shown in FIGS. 7 and 9 of the drawings, the temperature sensing device T has a pair of elongate wire leads which are suitably connected with inner cut ends 14'' of the conductors 14 within the loom L.

In accordance with common practice, the loom L has an outer flexible jacket 16 of electric insulative material. The inner or cut ends 14' of the conductors 14 are established by cutting the outer jacket 16 of the loom where the device T is to be located and exposing the conductors 14. Thereafter, the exposed portions of the conductors 14 are cut, as shown in FIG. 8 of the drawings, to establish the above referred to inner ends 14'', with which the wire leads 15 of the device T are connected.

After the wire leads 15 are connected with their related conductors 14, the cut and worked upon portion of the loom L is repaired or made whole again by a patch V which mends and/or seals the cut jacket 16 and encapsulates the device T within the loom. The patch V can be a vulcanized path or other equivalent type of patch. For example, the patch V could be established by a deposit of a suitable flexible potting material or silicone cement and/or sealant such as is commonly employed throughout the electrical arts.

In the case illustrated, for the purpose of illustration, the portions of the loom L in which the device T is arranged, is cut away and the patch V is shown filling the space left by the cut away portion of the loom. In practice, the jacket 16 of the loom need only be split to expose the conductors 14 and the exposed portions of the conductors 14 need only have short portions cut and removed to accommodate the device T and need only have short portions of their insulating jackets stripped therefrom to effect connecting of the wire leads 15 of the device T thereto.

When connecting and engaging the device T in the loom L in the foregoing manner, and upon subsequent patching of the loom, the work performed on the loom and the presence of the device T therein can be made substantially non-detectable.

The portion of the conductors 14 in the loom L occurring longitudinally inward of the device T are left to remain in the loom to impart desired fullness and stiffness in and to the inner end portion of the loom. (It would serve no useful end and only cause adverse effects if the unused inner end portions of the conductors 14 were removed from the loom).

The heat control unit U, which occurs at the exterior of the bed structure B and which is connected with an electrical power supply by its elongate flexible service cord S, includes a switching circuit connected with the cord S and with the lines 13 and 14 of the loom L (by means of the plugs 11 and 12). The switching circuit operates to start and stop the flow of current through the heater H when the temperature of the mattress M, sensed by the device T, drops below and rises above a desired set operating temperature.

The control unit U is preferably that heater control unit produced by Western Control Equipment Co. of Garden Grove, California and sold under the tradename "Ultratherm", but can be any one of several other heater control units, of similar nature, which are provided by the prior art and are readily available in the marketplace.

The control unit U includes a box-like body 20 which houses the referred to switching circuit and from which the service cord S extends. The circuit within the body includes a power plug receiving socket 21 accessible at one side of the body and in which the plug 11 at the outer end of the loom L is releasably engaged and a conductor plug receiving socket 22 accessible at the exterior of the body 20 and in which the conductor plug 12 at the outer end of the loom L is releasably engaged.

In addition to the above, the unit U has a manually engageable temperature setting control knob 23 accessible at the exterior of the body 20 and which is manually adjusted to set the temperature at which the switching circuit of the unit U opens and closes.

Since the switching circuit of the unit U can vary widely without in any way effecting the operation or spirit of my invention, I will not unnecessarily burden this disclosure with detailed description and illustration of any one of the numerous distinct circuits that might be employed. It is sufficient to note that the unit U includes a switching circuit with which the heater H, device T and a power supply are connected and which operates to open and close and to thereby start and stop the flow of current through the heater H, when the temperature of the temperature sensing device T drops below or exceeds a predetermined set operating temperature.

The unit U, as noted above, occurs at the exterior of the bed structure B and can be mounted on the frame F of the bed, as shown in FIG. 1, or can be set on the floor or any suitable supporting structure at one side of the bed structure, as shown in FIG. 2 of the drawings.

In either case, the loom L extends from within the bed structure to the unit U at the exterior of that structure and has a substantial and notable portion which is exposed and vulnerable to being inadvertently caught and pulled or otherwise worked upon by exterior forces.

Since the loom L is a jacketed 4 conductor cable, it is relatively stiff and strong and is such that if caught and pulled in the manner suggested above, there is little likelihood that any adverse effects will result.

The above would not be true if the two pairs of related lines 13 and conductors 14 of the loom L were made to establish a pair of light weight, highly flexible two-line power cords.

In the form of the invention illustrated and described above, the inner end portion of the loom L, between the device T and the heater H is sufficiently heavy and stiff so that it is not subject or likely to be bent double or backed upon itself so as to arrange or position the device T, or that portion of the loom in which the device T is arranged, in such close proximity with the heater H that the device T might be heated directly by the heater H, when the heater is energized. That is, the noted inner end portion of the loom L is sufficiently stiff and rigid so that it normally extends outwardly and away from the heater H to position and maintain the temperature sensing device T, within it, in desired spaced relationship from the heater.

In furtherance of my invention and as shown in FIG. 12 of the drawings, the inner end portion of the loom L, between the heater H and the device T, is provided with an elongate resilient spring means M to normally yieldingly urge and hold that portion of the loom substantially straight, as it extends from the heater H, whereby locating the device T below its related mattress M and in effective spaced relationship from the heater H, is substantially assured.

As shown in FIG. 12 of the drawings, the spring means M is a normally straight, resilient helical spring releasably engaged about the exterior of its related portion of the loom L. In practice, the spring means M can be a simple, normally straight length of spring wire engaged within the loom L in parallel relationship with the conductors 14 or engaged therein in place of the unused inner end portion of one of the conductors 14.

In practice and operation of my invention, the portion of the loom in which the device T is arranged is positioned to occur between the platform P and the bottom wall 10 of the mattress M in heat conducting contact therewith, whereby that portion of the loom and the temperature sensing device T within it are heated by and are normally at the same temperature as the mattress M.

The mass of the portion of the loom in the general area of the loom in which the device T occurs and which is likely to influence heating and cooling the device T, is insufficient to materially or adversely slow or delay heating and cooling of the device T in response to changes of temperature of the mattress M and is, in fact, such that the portion of the loom near the device T serves as an effective heat conducting means or heat pipe which conducts heat absorbs from the mattress M to the device T in those instances where, as a result of an adverse dispositioning of parts, the device T, or the portion of the loom immediately adjacent to it, are not in effective heat conducting contact with the mattress M.

In accordance with the above, and with the structure that I provide, should the device T occur in an area where the bottom wall of the mattress M is folded, wrinkled or otherwise upset so that effective heat conducting contact between the portion of the loom immediately adjacent the device T and the mattress M cannot be established, the portions of the loom extending away from the device and establish effective heat conducting contact with the mattress conduct heat from the mattress to the device for effective and dependable operation of the heating system.

In FIGS. 13 through 22 of the drawings, I have shown another form or embodiment of my invention wherein the loom L′ is established by a standard or conventional two-line power cord 30 extending from the heater H and coupled with the unit U by a plug 31; a standard or conventional two-line conductor cord 32 with which the device T is related and which is coupled with the unit U by a plug 33; and an elongate flexible jacket or sleeve 34 engaged about the cords 30 and 31 and the device T, to establish a unitary loom L′.

In addition to the above, a helical spring M′ can be and is preferably related to the loom L′ to yieldingly maintain the inner end portion of the loom substantially straight and to thereby hold the device T spaced from the heater H. The spring M′ is engaged about the inner end portion of the power cord 30 and is within the inner end portion of the sleeve 34, substantially as shown in the drawings.

This second form of my invention is intended to show that the invention that I provide can be put into practice by suitably relating and securing together the ordinary or conventional two-line heater power cords and ordinary or conventional two-line conductor cords for the temperature sensing device of a standard or conventional water bed heating system and that the provision and use an especially constructed loom, such as provided in the first form of my invention, is not essential.

In accordance with common practice, the bed structure B can be provided with a liner of thin, flexible sheet plastic within the recess defined by the platform and the retainer and in which the mattress is arranged. The liner is provided to capture and hold free water, should the mattress or otherwise fail. The inclusion of such a liner would not alter or affect the novelty of my invention.

Further, in practice, the bed structure can, if desired, include a soft resilient pad of foam plastic or the like between the platform and the mattress without departing from the spirit of this invention. Such a pad can be a part of the platform, a part of the retainer or can be an independent part as desired or as circumstances require. When such a pad is provided, the heater and its loom are simply arranged between the mattress and the pad and operate in the same manner as noted above. Such a pad, in whatever form it might take, can be considered to be a part or portion of the platform P so far as the present invention is concerned.

Having described only typical preferred forms and applications of my invention, I do not wish to be limited to the specific details herein set forth, but wish to reserve to myself any modifications and/or variations that may appear to those skilled in the art and which fall within the scope of the following claims:

Having described my invention, I claim:

1. In combination, a water bed structure comprising a flat horizontal mattress supporting platform, a water filled bladder type flotation mattress with top, bottom and side walls positioned above the platform with its bottom wall opposing said platform and a retainer projecting upwardly from the platform and occurring about the mattress in supported engagement with the side walls thereof; and a heater system to heat and maintain the mattress at a set operating temperature including a flat, horizontal heater with an elongate electric resistance element arranged between and in heat conducting contact with the platform and bottom wall of the mattress and spaced inward from the sides thereof; a control unit for the heater at the exterior of the bed structure and including a switching circuit connected with an electric power supply by an elongate service cord and controlled by a remote temperature sensing device in heat transfer relationship with the mattress to start and stop the flow of current through the heater when the temperature of the mattress is below and when that temperature reaches the set operating temperature, an elongate flexible electrical loom having inner and outer end portions and including an outer jacket, a pair of jacketed power lines coextensive with the loom and a pair of current conductors coextensive with the outer end portion of the loom, a thermoresponsive temperature sensing device within a central portion of the loom defined by the joinder of said inner and outer end portions and connected with and between the conductors, the inner end portion of the loom is joined with the heater with the ends of said lines connected with said element, the outer end portion of the loom joins with the control unit with said lines and said conductors connected with said switching circuit, the outer end portion of the loom extends from the unit between the platform and mattress and the inner end portion of the loom extends from the heater between the platform and the mattress to a zone between the platform and the mattress which is in thermally isolated spaced relationship from the heater and where said central portion of the loom in which the device is arranged is in heat conducting engagement with the mattress.

2. The combination set forth in claim 1 which further includes elongate spring means substantially coextensive with the inner end portion of the loom and yieldingly maintaining that portion of the loom substantially straight and extending from the heater toward said thermally isolated zone.

3. The combination set forth in claim 1 wherein the inner end of the loom is fixedly joined with the heater and the pair of lines and the pair of conductors at the outer end of the loom and their related parts of the switching circuit in the control unit are releasably connected by plug and socket type electric coupling means.

4. The combination set forth in claim 2 wherein the inner end of the loom is fixedly joined with the heater and the pair of lines and the pair of conductors at the outer end of the loom and their related parts of the switching circuit in the control unit are releasably connected by plug and socket type electric coupling means.

5. The combination set forth in claim 1 which further includes an elongate, normally straight spring engaged in and substantially coextensive with the inner end portion of the loom and yieldingly maintaining that portion of the loom substantially straight and extending from the heater toward said thermally isolated zone.

6. The combination set forth in claim 3 which further includes an elongate, normally straight spring engaged in and substantially coextensive with the inner end portion of the loom and yieldingly maintaining that portion of the loom substantially straight and extending from the heater toward said thermally isolated zone.

7. The combination set forth in claim 1 which further includes a normally straight, helical spring substantially coextensive with and arranged to extend about said lines in the outer end portion of the loom and yieldingly maintaining that portion of the loom substantially straight and extending from the heater to said thermally isolated zone.

8. The combination set forth in claim 3 which further includes a normally straight, helical spring substantially coextensive with and arranged to extend about said lines in the outer end portion of the loom and yieldingly maintaining that portion of the loom substantially straight and extending from the heater to said thermally isolated zone.

* * * * *